US007407279B2

(12) United States Patent
Nakashima

(10) Patent No.: US 7,407,279 B2
(45) Date of Patent: Aug. 5, 2008

(54) IMAGE FORMING APPARATUS AND CLEANING METHOD THEREOF

(75) Inventor: Atsuhisa Nakashima, Handa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 393 days.

(21) Appl. No.: 10/490,510

(22) PCT Filed: Mar. 6, 2003

(86) PCT No.: PCT/JP03/02678

§ 371 (c)(1),
(2), (4) Date: Mar. 23, 2004

(87) PCT Pub. No.: WO03/080486

PCT Pub. Date: Oct. 2, 2003

(65) Prior Publication Data

US 2005/0018028 A1 Jan. 27, 2005

(30) Foreign Application Priority Data

Mar. 6, 2002 (JP) ..... 2002-60179

(51) Int. Cl.
*B41J 2/01* (2006.01)

(52) U.S. Cl. ..... 347/104

(58) Field of Classification Search ..... 347/16, 347/22, 32, 34, 104
See application file for complete search history.

(56) References Cited

U.S. PATENT DOCUMENTS

| | | | | |
|---|---|---|---|---|
| 5,531,531 | A * | 7/1996 | Hirano | 400/629 |
| 5,708,467 | A * | 1/1998 | Yoshikawa et al. | 347/213 |
| 5,940,107 | A * | 8/1999 | Fox | 347/171 |
| 6,030,674 | A | 2/2000 | Onishi et al. | |
| 6,135,591 | A * | 10/2000 | Ikeda et al. | 347/104 |
| 6,271,872 | B1 * | 8/2001 | Nagata | 347/171 |
| 6,277,457 | B1 | 8/2001 | Onishi et al. | |
| 6,367,905 | B1 * | 4/2002 | Sharma et al. | 347/33 |
| 6,386,697 | B1 * | 5/2002 | Yamamoto et al. | 347/103 |
| 6,443,552 | B1 * | 9/2002 | Inoue et al. | 347/37 |
| 6,634,818 | B2 * | 10/2003 | Sato et al. | 400/624 |
| 2002/0027587 | A1 * | 3/2002 | Sugaya et al. | 347/104 |

FOREIGN PATENT DOCUMENTS

| | | |
|---|---|---|
| JP | A 63-8136 | 1/1988 |
| JP | A 63-230441 | 9/1988 |
| JP | A 4-148742 | 5/1992 |
| JP | A 8-310080 | 11/1996 |
| JP | B2 2705992 | 10/1997 |
| JP | A 11-192768 | 7/1999 |
| JP | A 2000-318864 | 11/2000 |
| JP | A 2001-150690 | 6/2001 |

* cited by examiner

*Primary Examiner*—Julian D. Huffman
*Assistant Examiner*—Jason Uhlenhake
(74) *Attorney, Agent, or Firm*—Oliff & Berridge, PLC

(57) ABSTRACT

For a cleaning the conveyor belt of the image forming apparatus, the adhesive surface of the sheet of the sheet roller abuts on the outer surface of the conveyor belt, and the conveyor belt is driven in a direction so that the sheet roller rotates to roll the sheet in order to conduct a cleaning. For a renewal of the sheet, the conveyor belt is driven in a direction so that the sheet roller to unroll the sheet, the sheet is unrolled for a predetermined length, adhered to the outer surface of the conveyor belt and cut off in order to renew the adhesive surface of the sheet of the sheet roller.

26 Claims, 12 Drawing Sheets

IMAGE FORMING APPARATUS AND CLEANING METHOD THEREOF

TECHNICAL FIELD

This invention relates to an image forming apparatus, cleaning method thereof and a cleaning unit.

BACKGROUND ART

Conventionally, as a recording apparatus which records on a recording medium such as paper, an image forming apparatus having an inkjet head is known. This image forming apparatus comprises a conveying mechanism which conveys a recording medium in the form of sheets, e.g. paper. A conveyor belt is disposed therein as a conveying device of a recording medium. In the conveying mechanism, as the number of conveyed recording media to be printed increases, foreign objects such as paper dust or dust of dried ink adhere to the conveyor belt. The foreign objects or dirt adhered to a conveyor belt are removed by way of raking with a blade disposed in a path of a conveyor belt, electro static adsorption, adhesion adsorption, vacuum adsorption or having an a water-bearing roller or brush abut on the conveyor belt.

However, with the conventional skill described above, the cleaning capability deteriorates gradually as more foreign objects such as dirt or ink adhere to a surface of a conveyor belt, and sufficient cleaning capability cannot be achieved. Moreover, mechanical cleaning such as with a blade or a brush has included possibility that some conveyor belts, depending on the material, could be scratched by a blade or a brush when being cleaned thereby.

On the other hand, various devices and methods for a direct cleaning of a recording medium are conventionally known.

For example, the patent document 1 identified below discloses an art to adhere powder dust remained on a recording medium to an adhesive sheet by unrolling the adhesive sheet from an unrolling roller disposed in a feed path of a recording medium, and rolling the adhesive sheet with a collection roller disposed above the unrolling roller.

In case of this art, however, one pair of unrolling and collection rollers is always required. Particularly, space for collection roller is necessary. Furthermore, a mechanism such as a roll drive device is required to roll an adhesive sheet on a collection roller. It has consequently made the size of an image forming apparatus larger, or caused possibility of making the entire mechanism of an image forming apparatus complicated.

Additionally, a cleaning with a cleaning roller which has an adhesive sheet applied to its surface is suggested. However, in this case, the adhesive sheet whose cleaning capability has gone down needs to be replaced manually to a new sheet.

(Patent document 1)

Unexamined Japanese patent publication No. 2000-318864

DISCLOSURE OF INVENTION

The present invention was made in order to solve above issues and its purpose is to provide an image forming apparatus which is capable of keeping a conveying surface of a conveying device which conveys a recording medium constantly clean.

To achieve the above object, an image forming apparatus according to the present invention comprises: a conveying device having a conveying surface to convey a recording medium; a sheet roller mounted rotatably and rolled with a sheet having a cleaning surface which abuts on the conveying surface to clean the conveying surface; and a drive control device which drives the conveying device so that the sheet roller rotates in a direction to roll the sheet when a cleaning is conducted, and rotates in a direction to unroll the sheet when the cleaning surface is renewed.

With the constitution described above, by driving the conveying device in a predetermined manner with an appropriate control on the drive control device, a cleaning on the conveying surface and a renewal of the sheet whose cleaning capability has decreased can be fully automatically conducted without a manual operation. As a result, the conveying surface of the conveying device can be kept constantly clean.

Since a cleaning operation and a sheet renewal are conducted only by the sheet roller abutting on the conveying surface and controlled on the rotational directions, a collection roller to roll or collect the sheet is not required. In consequence, an image forming apparatus can be constituted compactly.

The conveying device comprises a conveyor belt which is preferably extended rotatably between at least two rollers and conveys the recording medium.

Thereby, the conveyor belt extended between two rollers can convey the recording medium.

The conveying surface of the conveyor belt preferably comprises an adhesive member constituted with silicone resin.

Consequently, foreign objects adhered to the conveying surface such as paper dust can be caught. Moreover, the adhesion on the adhesive member of the conveying surface holds a recording medium on a predetermined position on the conveying surface and can prevent a displacement of a recording medium from the conveying surface caused by vibration or shock given to a recording medium in a conveyance.

The sheet roller is preferably disposed in the vicinity of one of the two rollers.

With above disposition, the sheet roller can be arranged so as to abut certainly on a portion of the conveyor belt where one of the two rollers is abutting thereon, but not on a portion of the conveyor belt between the two rollers, when the sheet roller abuts on the conveying surface of the conveyor belt. Furthermore, accidental exfoliation of the sheet from the conveying surface can be prevented because the sheet is unrolled from the sheet roller to the linear portion of the conveying surface between the two rollers as described hereinafter.

A shift device is preferably comprised to make the sheet roller abut on the conveying surface and separate therefrom.

Accordingly, the shift device can make the sheet roller abut on the conveying surface and clean thereon when a cleaning is conducted, and keep the sheet roller separated from the conveying surface when a cleaning is not conducted. This constitution enables the sheet to constantly demonstrate desired adhesion to the conveying surface. Therefore an effective cleaning on the conveying surface is achievable.

When the sheet is renewed, the shift device described above enables the sheet roller to abut on the conveying surface and the sheet to be unrolled for a predetermined length for a renewal.

The shift device preferably comprises a support portion which supports the sheet roller rotatably and detachably.

Consequently, the sheet roller can be mounted rotatably and detachably on the support portion. It makes a replacement of the sheet roller easy.

The shift device preferably biases the sheet roller toward the conveying surface with a biasing device.

With this constitution, even when the diameter of the sheet roller becomes small in the result of renewals of the cleaning surface, the sheet roller can constantly abut on the conveying surface by means of the biasing device.

The shift device preferably comprises turn levers for supporting the sheet roller rotatably, being supported rotatably around an axis parallel to the shaft center of the sheet roller, and biasing the sheet roller toward the conveying surface with the biasing device; and a cam for turning the turn levers so that the sheet roller separates from the conveying surface against the biasing force of the biasing device.

With the constitution described above, it is possible to make the sheet roller surely separate from the conveying surface and abut thereon by the cam turning the turn lever around a predetermined point against the biasing force from the biasing device.

The cam preferably comprises a cam surface which switches between a position wherein the sheet roller is separated from the conveying surface and a position wherein the sheet roller abuts on the conveying surface.

Consequently, by driving the cam, the abuttment position of the cam surface and the turn levers can be changed. This change in the abuttment position surely turns the turn levers and enables to switch the position wherein the sheet roller is separated from the conveying surface and the position wherein the sheet roller abuts on the conveying surface.

The cam is preferably a rotational cam.

A rotation stopper device which stops the rotation of the sheet roller is preferably comprised in order to regulate rotational amount of the sheet roller in the unrolling direction of the sheet.

With the constitution described above, after predetermined amount of the sheet is unrolled from the sheet roller, the rotation of the sheet roller can be stopped by the rotation stopper device.

The rotation stopper device is preferably integrated with the cam.

Consequently, the rotation stopper device can be constituted more compactly in relation to the cam.

Incisions are preferably formed on the sheet with predetermined length of intervals in the direction perpendicular to the rolling direction.

Thereby, if the conveying device is adapted to be driven even after the rotation of the sheet roller stops, it is possible to cut off the sheet on the incisions arranged along the direction perpendicular to the rolling direction of the sheet unrolled on the conveying surface of the conveying device.

The cleaning surface is preferably constituted with a sticky member whose adhesive force to foreign objects adhered to the conveying surface is preferably larger than the adhesive force of the foreign objects to the conveying surface.

Consequently, foreign objects adhered to the conveying surface can be surely caught on the cleaning surface. Hence, foreign objects can be conveniently removed from the conveying surface.

The diameter and rotational speed of the roller and the adhesive force and stiffness of the sheet are preferably adjusted so that the sheet exfoliates automatically from the conveying surface in the vicinity of the roller.

Accordingly, a mechanism or a device is not specially required to be arranged to peel off the sheet from the conveying surface in the vicinity of the roller. This can make an image forming apparatus more compact.

The sticky member is preferably constituted with a kind of resin in other group than the group to which the resin constituting the adhesive member belongs.

The adhesive member of the conveying surface on which the sheet abuts is constituted with, for example, silicone resin. Since the sticky member of the cleaning surface of the sheet is constituted with a kind of resin in other group than silicone, the adherence which works between the adhesive member of the conveying surface and the sticky member of the cleaning surface is smaller than adherence achievable by other combinations of adhesives in other groups. Therefore the cleaning surface effectively catches foreign objects adhered to the conveying surface and ejection of the sheet which has caught these foreign objects can be conducted more smoothly.

The drive control device preferably comprises a cleaning requirement determination device which determines whether or not a cleaning on the conveying surface is required.

Consequently, the time when a cleaning on the conveying surface is required can be informed.

The cleaning requirement determination device preferably comprises a detection device for the number of conveyed paper and determines that a cleaning on the conveying surface is required when the number of conveyed paper reaches a predetermined number.

Accordingly, when the number of the recording media conveyed to the image forming area reaches a predetermined number, it is determined that a cleaning on the conveying surface is required.

The drive control device preferably comprises a sheet renewal requirement determination device which determines whether or not a renewal of the sheet is required.

Consequently, the time when a sheet renewal is required can be informed.

The sheet renewal requirement determination device preferably comprises a cleaning number detection device which detects the number of cleanings on the conveying surface by the sheet, and determines that a renewal of the sheet is required when the cleaning number reaches a predetermined number.

Accordingly, when the cleaning number on the conveying surface by the sheet reaches a predetermined number, a renewal of the sheet can be determined to be required.

The drive control device preferably comprises a shift control device which makes the sheet roller abut on the conveying surface with the shift device corresponding to the cleaning requirement determination device determining that a cleaning on the conveying surface is required.

The drive control device preferably changes the movement direction of the conveying device corresponding to the sheet renewal requirement determination device determining that a sheet renewal is required. Thereby, the drive control device preferably unrolls the sheet for a predetermined length and adheres the sheet to the conveying surface.

A cleaning unit according to the present invention is a cleaning unit to clean a conveying surface of a conveying device which conveys a recording medium. The cleaning unit comprises a sheet roller abutting on the conveying surface, constituted with a sheet having a cleaning surface for cleaning rolled thereon, and arranged rotatably; a shift device which makes the cleaning surface of the sheet roller abut on the conveying surface and separate therefrom and makes the cleaning surface of the sheet roller abut on the conveying surface when a cleaning is conducted; and a cutter device to cut off the sheet when the sheet is unrolled to renew the cleaning surface.

Furthermore, the cleaning method of the image forming apparatus according to the present invention is a cleaning method of an image forming apparatus which comprises a conveying device having a conveying surface to convey a recording medium, a sheet roller constituted with a sheet having a cleaning surface which abuts on the conveying surface to clean the conveying surface rolled thereon and mounted rotatably, a shift device which makes the sheet roller abut on the conveying surface and separate therefrom, and a drive control device which drives the conveying device wherein, for a cleaning, the cleaning surface of the sheet roller is abutted on the conveying surface by the shift device, the conveying device is driven by the drive control device in a direction so that the sheet roller rotates in a direction in which the sheet is rolled thereon, and thereby the sheet roller conducts a cleaning on the conveying surface, and for a renewal of the cleaning surface, the sheet roller rotates in a direction in which the sheet is unrolled therefrom, and the drive control device reverses the rotational direction of the conveyor belt with the drive control device so that the sheet is unrolled for a predetermined length and adheres to the conveying surface.

The image forming apparatus furthermore comprises a cutter device to cut off an unrolled portion of the sheet and a step to cut off an unrolled portion of the sheet with the cutter device. The cleaning method furthermore comprises a step to separate the sheet roller from the conveying surface by the shift device when a cleaning is completed.

BEST MODE FOR CARRYING OUT THE INVENTION

Figure 1:
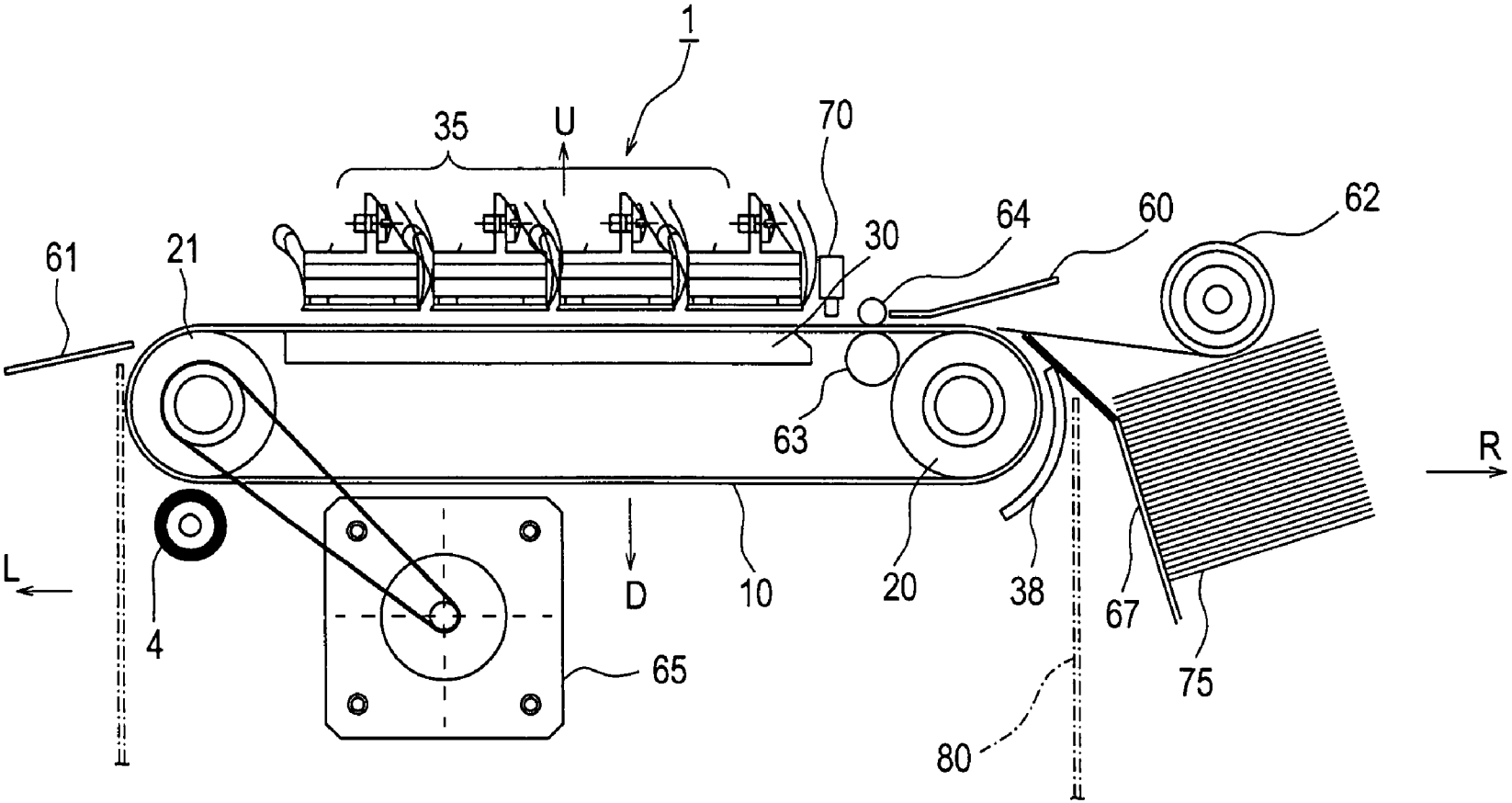
FIG. 1 shows a conveying mechanism of an inkjet printer and substantial part of a cleaning mechanism.

Embodiments to which the present invention is applied are going to be described hereinafter referring to the drawings. It should be noted that the present invention is not limited to the following embodiments, and other modifications and variations are possible within the scope of the present invention.

Figure 2:
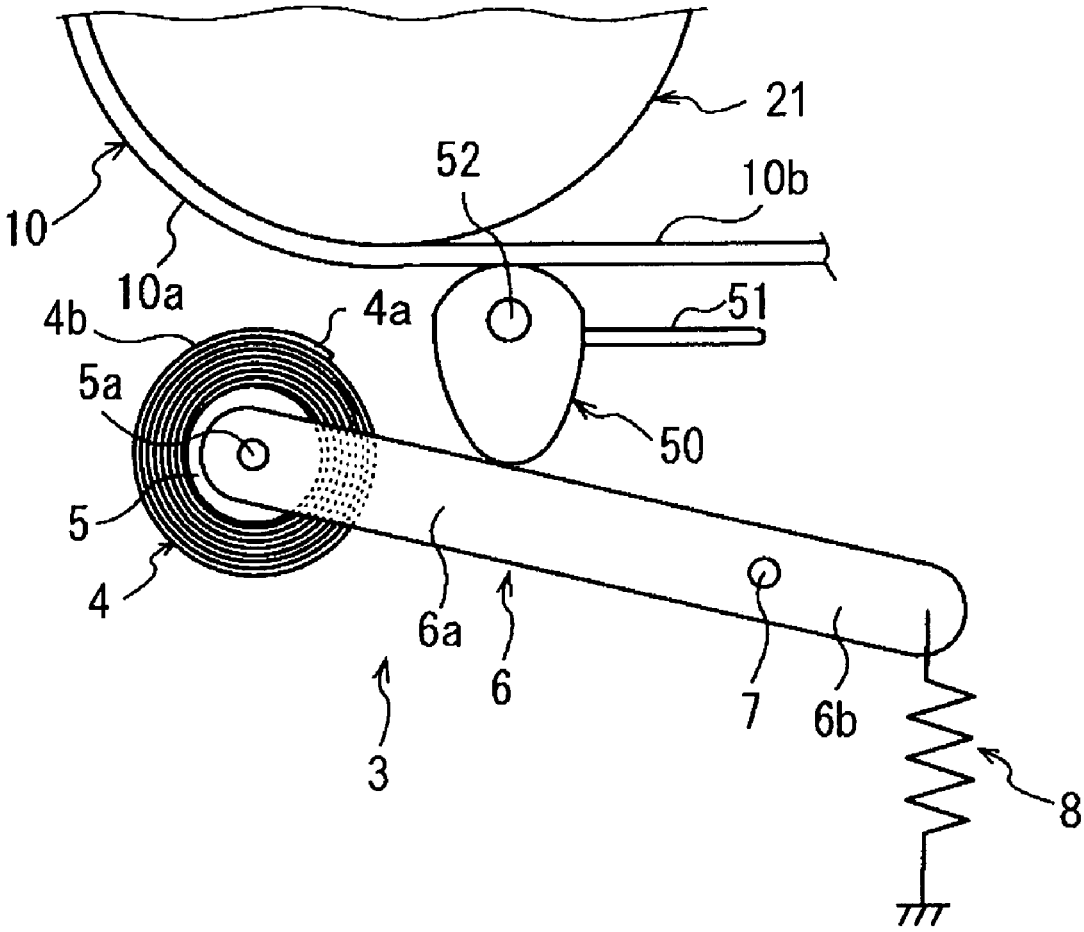
FIG. 2 is a partially enlarged view of FIG. 1.

The followings describe an inkjet printer in which the image forming apparatus of the present invention is embodied. FIG. 1 shows a conveying mechanism of an inkjet printer and substantial part of a cleaning mechanism. FIG. 2 is a partially enlarged view of FIG. 1.

In FIG. 1, a conveying mechanism 1 of the inkjet printer is constituted with a conveyor belt 10 as a conveying device, two conveying rollers 20 and 21, conveying roller drive motor 65 and the like. A cleaning mechanism is constituted with a sheet roller 4 and the like.

It should be noted that in the present embodiment, the right side of the drawing (the side of R direction in FIG. 1) is the upstream side of the conveying direction of a recording medium, and the left side of the drawing (the side of L direction in FIG. 1) is the downstream side of the conveying direction of a recording medium. Therefore a recording medium; paper 75 is conveyed from the right side (the side of R direction in FIG. 1) to the left side (the side of L direction in FIG. 1). In other words, the conveying direction of the conveyor belt 10 to convey a recording medium is in the counterclockwise direction.

The endless conveyor belt 10 is extended between the conveying roller 20 positioned in the upstream side of the conveying direction and the conveying roller 21 positioned in the downstream side of the conveying direction. The material of the conveyor belt 10 will be described in detail afterward.

In the farther upstream side of the conveying roller 20 in the upstream side of the conveying direction, a paper feed tray 67 for supplying a recording medium, i.e. the paper 75, and a pick-up roller 62 which picks up the paper 75 from the paper feed tray 67 are disposed.

The paper 75 picked up by the pick-up roller 62 is guided by a paper feed guide 60 onto the conveyor belt 10 and conveyed via nip rollers 63 and 64 toward an inkjet head 35.

In FIG. 1, the numeral 70 indicates a detection sensor for the number of conveyed paper which detects the number of conveyed paper 75.

In the farther downstream side of the conveying roller 21 in the downstream side of the conveying direction, a paper ejection guide 61 which guides the paper 75 to outside of the conveying mechanism 1 is disposed.

The conveying roller 21 located in the downstream side of the conveying direction is driven by the conveying roller drive motor 65 located under the conveyor belt 10 (in the D direction side of FIG. 1). In the present embodiment, the conveying roller 21 located in the downstream side of the conveying direction is driven. Instead of the conveying roller 21, the conveying roller 20 in the upstream side of the conveying direction may be driven by the conveying roller drive motor 65.

As described above, the conveyor belt 10 forms circular arc portions formed in generally semicircular shapes respectively at the upstream and downstream sides of the conveying direction, and linear portions formed in generally linear shapes between the conveying rollers 20 and 21 respectively on the upside and downside between the circular arc portions. In the region of the center part of the conveying direction of the upper linear portion of the conveyor belt 10, that is in the printing area to print on the paper 75, a belt guide 30 which is a metal plate-shaped member to hold the conveyor belt 10 horizontally to the inkjet head 35 is disposed. By this belt guide 30, the conveyor belt 10 is pressed from the downside in the printing area.

On an outer surface 10*a* of the conveyor belt 10 shown in FIG. 2 which is a conveying surface to mount and convey a recording medium, an adhesive member is applied. While the paper 75 which is a recording medium is supplied to the conveyor belt 10 and conveyed, vibration or shock is sometimes given to the paper 75. This causes displacement of the paper 75 before the paper 75 reaches the printing area or even when the paper 75 is in the printing area. Hence, good printing quality may not be achieved.

As an adhesive member is adhered to the surface on which the paper 75 is mounted, the adhesion of the adhesive member holds a recording medium. Thus, at least before and after the paper 75 passes through the printing area, printing can be conducted without displacement of the paper 75. The adhesive member to be applied on the conveying surface is only required to have such adhesion so that the adhesive force of the sheet 4*a* to foreign objects adhered on the conveyor belt 10 becomes stronger than the adhesion of the adhesive member applied on the conveyor belt 10 to foreign objects. The material of the adhesive member is not limited to a particular kind, however, silicone rubber, for example, is preferably used as the adhesive member.

Between the two conveying rollers 20 and 21, in the downside (the D direction side of FIG. 1) of the conveying roller 21 in the downstream side of the conveying direction, a cleaning mechanism is disposed, as shown in FIG. 2.

The cleaning mechanism comprises a sheet roller 4 which cleans the conveyor belt, a shift member 3 as a shift device to make the cleaning surface of the sheet roller 4 abut on the conveying surface and separate therefrom, and a rotation stopper member 51, which is to be hereinafter described, to cut off the sheet when the sheet is unrolled in order to renew the cleaning surface.

The shift member 3, as shown in FIG. 2, is constituted with turn levers 6 and a cam 50. The turn levers 6 support the sheet roller 4 on one ends thereof so that the sheet roller 4 can rotate around a shaft center 5*a* and can be detachable. At the same time, the turn levers 6 are supported rotatably around a shaft member 7 which is a fixed shaft parallel to the shaft center 5*a*. On the other ends of the turn levers 6, a tension spring 8 is installed as a biasing device. By this spring 8, the sheet roller 4 is biased toward the outer surface 10*a* of the conveyor belt 10. The cam 50 turns the turn lever 6 against the biasing force of the spring 8 so that the sheet roller 4 separates from the outer surface 10*a* of the conveyor belt 10.

The sheet roller 4 comprises a cylindrical core member 5 extending toward the depth direction of FIG. 2 to roll aforementioned sheet roller 4 thereon. The sheet roller 4 is constituted with the adhesive sheet 4*a* rolled rightward thereon in a roll shape. The adhesive surface 4*b* which is the outer and cleaning surface of the sheet 4*a* works as a sticky member which adheres foreign objects such as paper dust or dust of dried ink adhered to the outer surface 10*a* of the conveyor belt 10.

The sticky member is preferably constituted with adhesives made of resin which belong to other groups than silicone, for example, epoxy, vinyl or acryl system.

Figure 5:
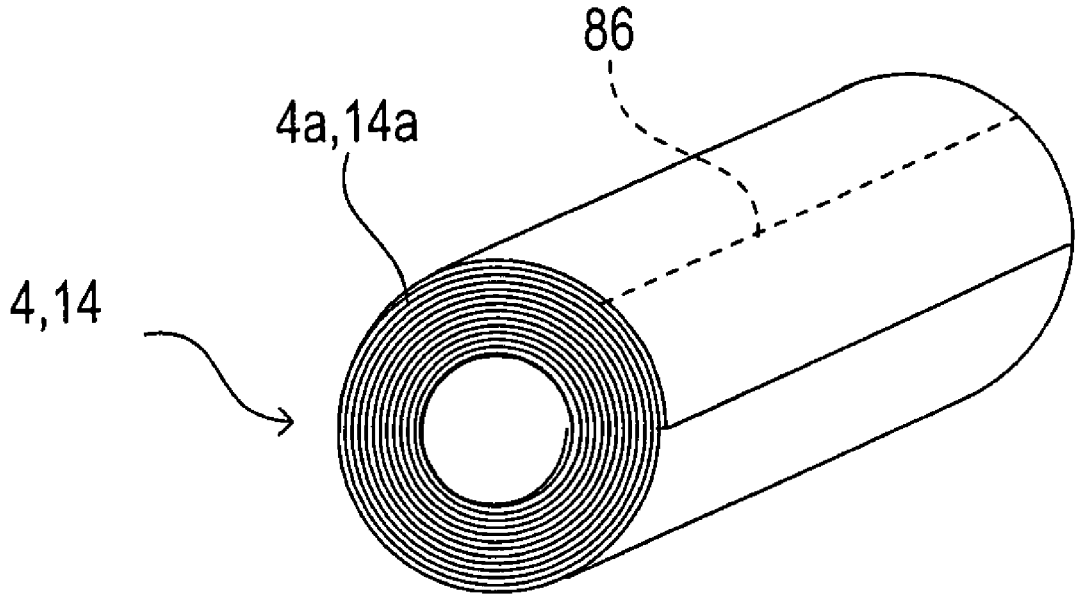
FIG. 5 shows a sheet roller.

On the sheet 4*a*, as shown in FIG. 5, there are incisions 86 extending in a direction perpendicular to the rolling direction and disposed along with the rolling direction with predetermined intervals. On these incisions 86, the sheet 4*a* is cut off from the sheet roller 4.

Figure 4:
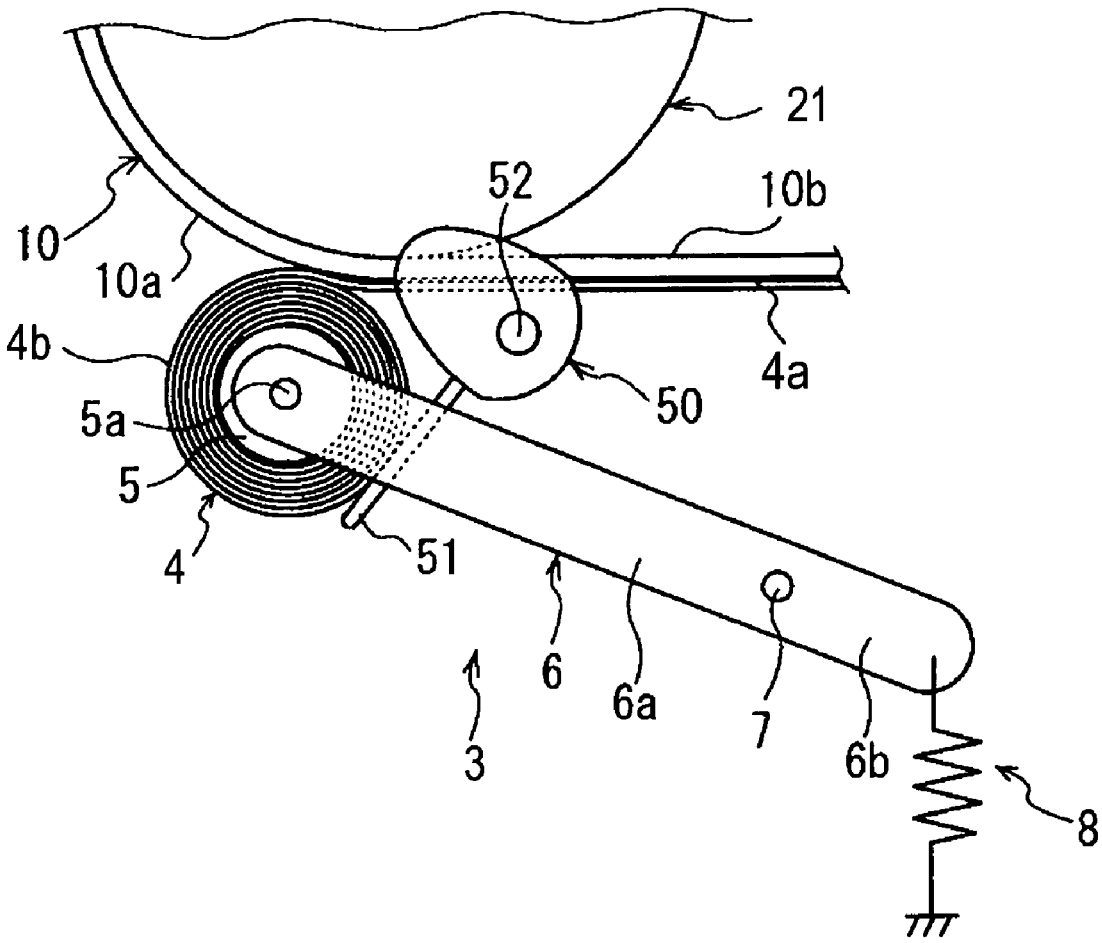
FIG. 4 is a partially enlarged view of FIG. 1 showing a state wherein a sheet is unrolled from a sheet roller and rotation of a sheet roller is stopped by a rotation stopper device.

The sheet roller 4 can rotate with the rotation of the core member 5 while contacting with the outer surface 10*a* of the conveyor belt 10. When the conveyor belt 10 rotates in the conveying direction (counterclockwise direction) while the sheet roller 4 abuts on the outer surface 10*a* of the conveyor belt 10, as shown in FIG. 4, the adhesive surface 4*b* of the sheet 4*a* is unrolled adhering to the outer surface 10*a* of the lower linear portion of the conveyor belt 10. On the other hand, when the conveyor belt 10 rotates in the opposite direction, the sheet roller 4 rotates to conduct a cleaning as the sheet 4*a* is adhered to the conveyor belt 10 but not unrolled.

Moreover, to the both ends in the length direction (the depth direction of FIG. 2) of the shaft center 5*a* of the core member 5 are connected to each one end of the turn levers 6 which are to shift the sheet roller 4 and the core member 5 to the directions to abut on the conveyor belt 10, or to separate from the conveyor belt 10.

The turn levers 6 are plate-shaped members in generally rectangular shapes having rectangular cross section with rounded ends. In the vicinity of the end of the turn lever 6 to which the spring 8 is connected, the shaft member 7 in a cylindrical shape extending generally parallel to the direction of the length of the shaft center 5*a* is disposed. The turn levers 6 have a longer arm (hereinafter referred to as "long arm") 6*a* in the downstream side of the conveying direction, and a shorter arm (hereinafter referred to as "short arm") 6*b* in the upstream side of the conveying direction respectively, having the shaft member 7 in between. To the long arm 6*a* side, the sheet roller 4 is connected. To the short arm 6*b* side, the spring 8 is connected.

Furthermore, the other end of the spring 8 opposite to the end to which the turn lever 6 is connected to a frame of the inkjet printer biasing constantly the leading ends of the short arms 6*b*, that is the ends of the turn levers 6 in the upstream side, toward the downside (D direction of FIG. 1).

Regarding to the shaft member 7, the sheet roller 4 connected to the ends in the long arm 6*a* side opposite to the short arm 6*b* side is, therefore, constantly biased upward (U direction of FIG. 1), that is in the direction toward the outer surface 10*a* of the conveyor belt 10.

Between the turn levers 6 and the conveyor belt 10, the cam 50 is disposed abutting the turn levers 6 to turn the turn levers 6 around the shaft member 7.

The cam 50 is fixed to a shaft 52 which is rotated by a cam drive motor 66, and turned in the clockwise and the counterclockwise directions along with the shaft 52.

The cam 50 is an elliptic board having its cross section vertical to the axial direction of a shaft center 5*a* of the shaft member 5 (the cross section parallel to the surface of the paper of FIG. 2) generally in elliptic shape. The shape of this elliptic board is symmetric across a straight line (reference line) going through the center of the shaft 52. The cam 50, on its peripheral surface, has a cam surface which switches the position of the sheet roller 4 separated from the outer surface 10*a* of the conveyor belt 10 and the position of the sheet roller 4 contacting the outer surface 10*a* of the conveyor belt 10. The position of the sheet roller 4 contacting the outer surface 10*a* of the conveyor belt 10 mentioned herein includes the position of the sheet roller 4 contacting the outer surface 10*a* of the conveyor belt 10 when the external diameter of the sheet roller 4 becomes the smallest after the sheet 4*a* being unrolled until the end.

On the lateral of the cam 50, the rotation stopper member 51 formed as a plate-shaped member generally in a rectangular shape extending parallel to the axial direction of the shaft center 5*a* of the shaft member 5 and integrated with the cam 50 is also fixed vertically to the above-mentioned reference line as a rotation stopper device.

The rotation stopper member 51 rotates with the cam 50 and regulates the rotation of the sheet roller 4 by contacting with the sheet roller 4. That is, the rotation stopper member 51 regulates the amount of rotation of the sheet roller 4 in the direction of the sheet 4*a* being unrolled from the sheet roller 4. It is to be noted that the rotation stopper member 51 only needs to be fixed so that the rotation stopper member 51 changes its positions in accordance with a change in the postion of the cam 50. For example, the rotation stopper member 51 can be fixed on the lateral of the cam 50 or the shaft 52 which is the rotational center of the cam 50, or can be formed separately from the cam 50.

The cam 50 is rotatable around the shaft 52 mounted eccentrically thereon. The cam 50 is driven by the cam drive motor 66, for example a pulse motor, which is regulatable of the amount and direction of rotation. By rotation of the cam 50, the cam surface which is the outer side of the cam 50 abuts on the lateral of the long arms 6*a* of the turn levers 6 and presses the long arms 6*a* downward against the biasing force of the spring 8. The turn levers 6, thus, rotate around the shaft member 7 in the clockwise or counterclockwise directions.

Meanwhile, the turn levers 6, the shaft member 7, the cam 50 and the rotation stopper member 51 can be constituted with, for example, resin or metal.

Figure 6:
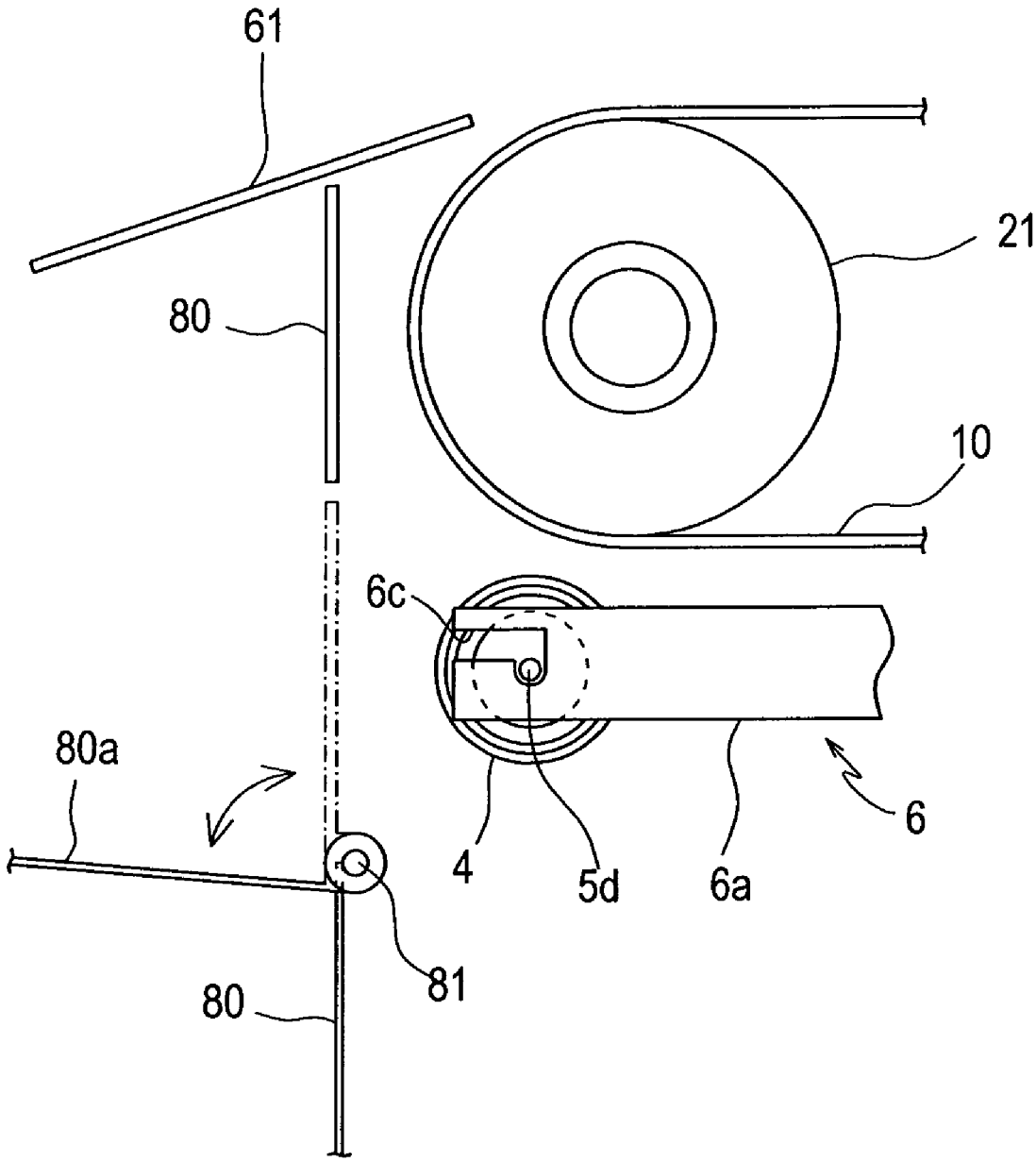
FIG. 6 is an enlarged view of a conveying roller disposed in an ejection side of a conveying mechanism of an inkjet printer.

Next, the conveying roller 21 in the paper ejection side of the conveying mechanism 1 is enlarged and shown in FIG. 6. As shown in the drawing, when the sheet roller 4 is located in the vicinity of the conveying roller 21 in the downstream side of the conveyor belt 10, interference does not occur with the paper feed tray 67 located in the vicinity of the conveying roller 20 in the upstream side of the conveyor belt 10. Since the sheet roller 4 is detachably supported by the turn levers 6, a user can replace the sheet roller 4 only by turning a cover 80*a* around the hinge 81*a* disposed in one part of a case 80 of the conveying mechanism 1 to open the cover and inserting a sheet roller 4 into a slot formed on the ends of the turn levers 6. Therefore, maintenance of the sheet roller 4 can be done easily. In FIG. 6, on the long arms 6*a* of the turn levers 6, slip slots 6*c* to insert or remove the sheet roller 4 from the side of cover 80*a*, and receivers 5*d* which receive the shaft center 5*a* rotatably in the recessed part of the slip slots 6*c* are formed.

Furthermore, as shown in FIG. 1, on the outer side of the conveying roller 20 located in the upstream side of the conveying direction, a guide member 38 having predetermined thickness and a cross section generally in semicircular shape is disposed along the conveyor belt 10.

The guide member 38 covers generally entire part of the circular arc portion of the conveying roller 20 in the upstream side of the conveying direction of the conveyor belt 10. When a piece of sheet 4*a* cut off from the sheet roller 4 and remained flat on the outer surface 10*a* of the conveyor belt 10 is conveyed by the conveyor belt 10, the guide member 38 prevents the piece of sheet 4*a* from coming off from the conveyor belt 10 in the vicinity of the crossover of the lower linear portion of the conveyor belt 10 between the conveying rollers 20 and 21 and the circular arc portion of the conveying roller 20 in the upstream side of the conveying direction. The detail will be described hereinafter.

Figure 7:
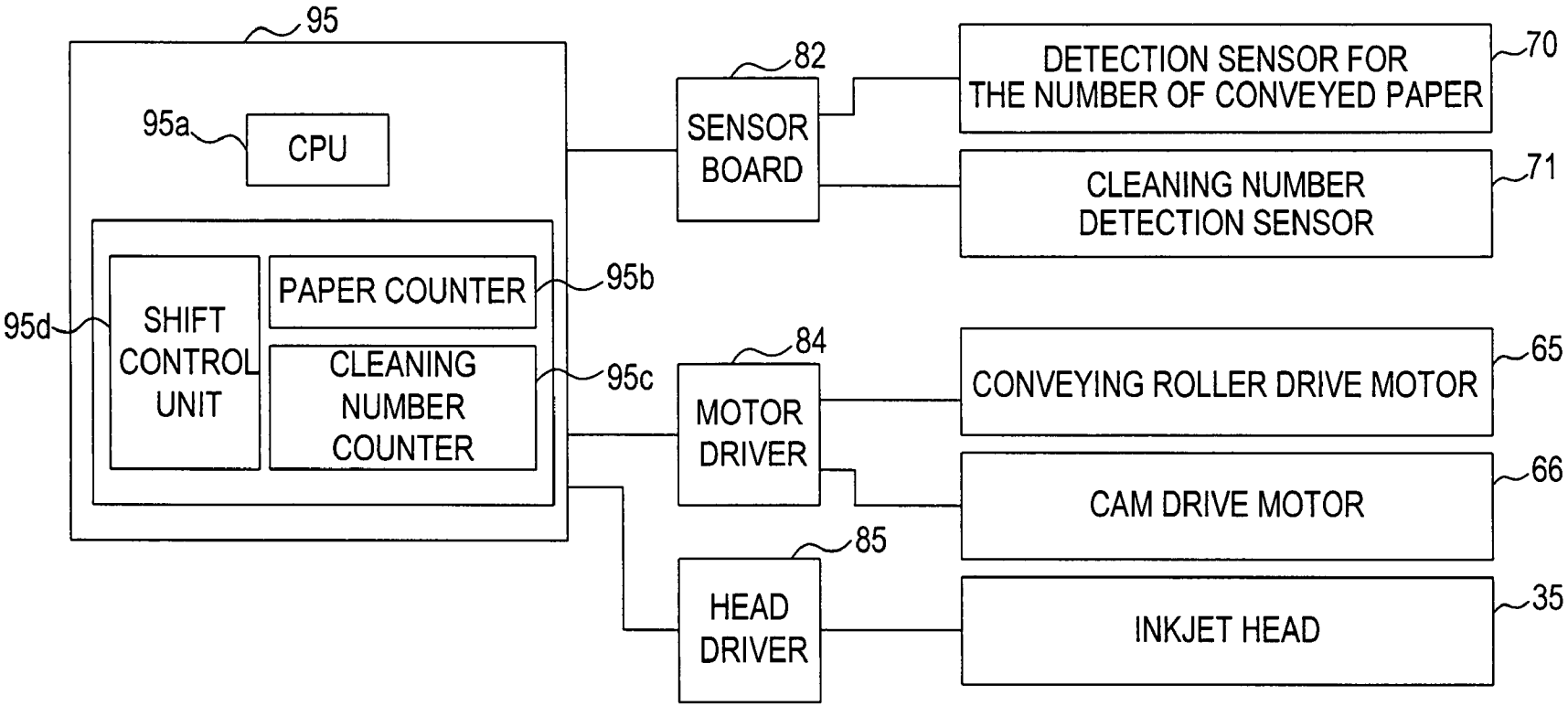
FIG. 7 is a block diagram showing a drive control device.

FIG. 7 is a block diagram showing the drive control unit 95.

As shown in FIG. 7, the drive control unit 95 which is a drive control device is constituted as a computer circuit with a CPU 95*a*, a ROM, a RAM and an input/output interface. The drive control unit 95 comprises a counter for the number of conveyed paper 95*b* to determine whether or not a cleaning on the conveying surface is required, a cleaning number counter 95*c* to determine whether or not a sheet renewal is required, and a shift control unit 95*d* to control the shift member 3 as a shift control device. The CPU 95*a* executes various processes in accordance with a control program recorded in the ROM and functions as a cleaning requirement determination device and a sheet renewal requirement determination device.

The drive control unit 95 is connected through a sensor board 82 to the detection sensor for the number of conveyed paper 70 and a cleaning number detection sensor 71. Instructions from the drive control unit 95 are relayed to a motor driver 84 and transmitted to the conveying roller drive motor 65 and the cam drive motor 66 respectively.

The drive control unit 95 is furthermore connected through a head driver 85 to the inkjet head 35.

A recording medium is picked up by the pick-up roller 62 from the paper feed tray 67, loaded on the conveyor belt 10 from the side of the conveying roller 20 located in the upstream side of the conveying direction, pressed on the adhesive member of the conveyor belt 10 by the nip rollers 63 and 64, and held on the adhesive member. Subsequently, the recording medium is conveyed to the printing area and printed by the inkjet head 35. After printing, the recording medium is conveyed toward the conveying roller 21 in the downstream side of the conveying direction by the conveyor belt 10. At the conveying roller 21, since the conveyor belt 10 curves along the conveying roller 21, the recording medium exfoliates from the adhesive member of the conveyor belt 10, guided by the paper ejection guide 61 and ejected outside of the conveying mechanism 1.

The number of conveyed recording media detected by the detection sensor for the number of conveyed paper 70 is counted by the counter 95*b* for the number of conveyed paper. The CPU 95*a* determines whether or not cleaning is required by the number. The number of sheet cleaning detected by the cleaning number detection sensor 71 is counted by the cleaning number counter 95*c*. The CPU 95*a* determines whether or not a sheet renewal is required by the number.

Figure 8:
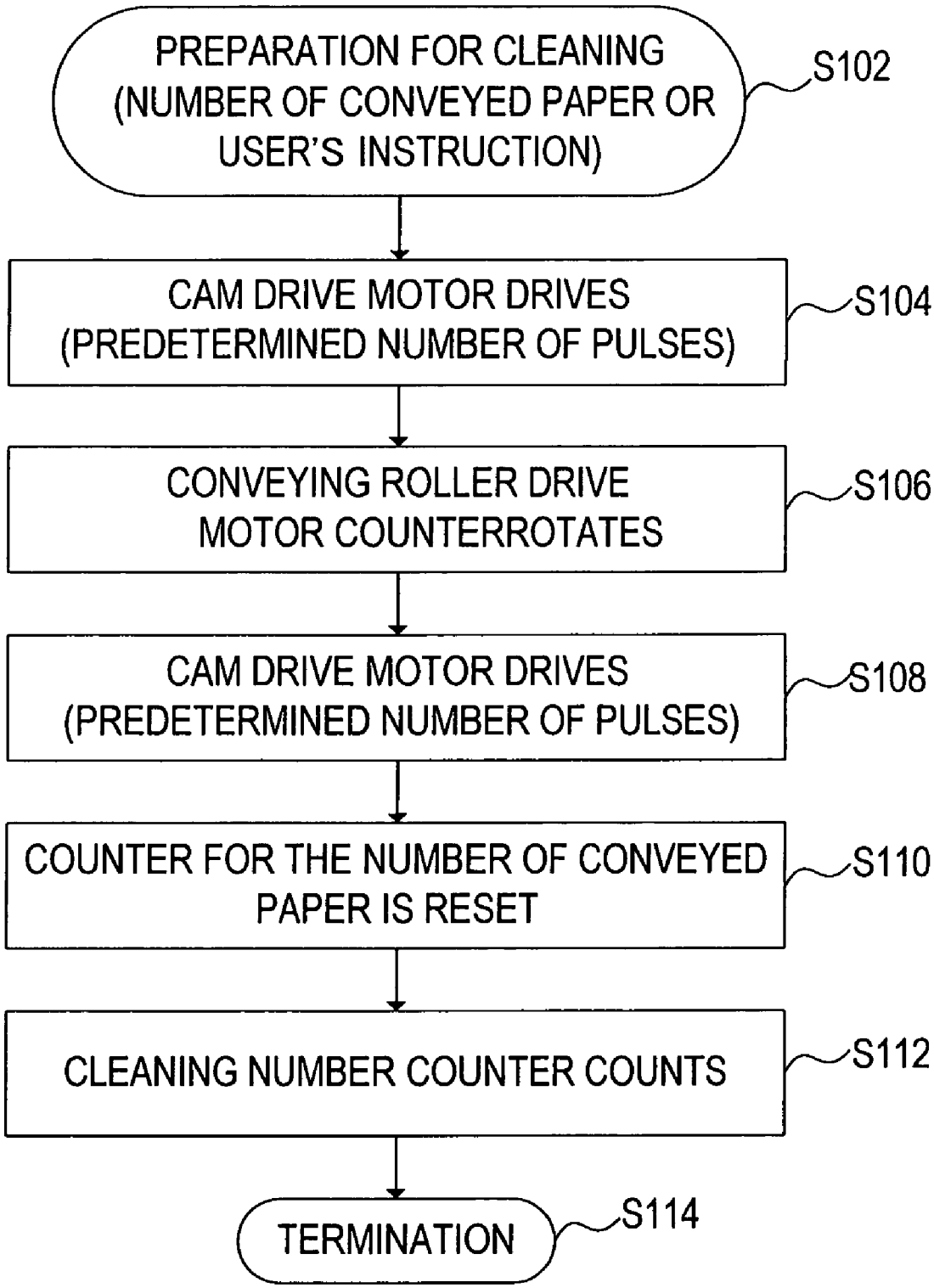
FIG. 8 is a flowchart showing a cleaning operation.

Next, the cleaning operation of the conveyor belt 10 is described based on the flowchart of CPU operation shown in FIG. 8. The CPU 95*a* executes determination of the number of conveyed paper in Step 102 (referred to as S102 hereinafter) of FIG. 8 at every printing on one sheet of a recording medium, and when the number of conveyed paper has not yet reached the preset number, the CPU 95*a* does not execute the subsequent processes.

In S102 of FIG. 8, the number of conveyed recording media is read from the counter 95*b* for the number of conveyed paper. The number of conveyed paper is determined whether or not it has reached the predetermined number. When the number has reached the predetermined number and after printing is over, the CPU 95*a* determines that cleaning is required, outputs a cleaning instruction and stops the rotation of the conveyor belt 10. The cleaning instruction can be done also by a manual operation on a switch by a user, other than by a determination of the CPU 95*a* according to the count on the number of conveyed paper counted by the counter 95*b* for the number of conveyed paper as described above.

Figure 3:
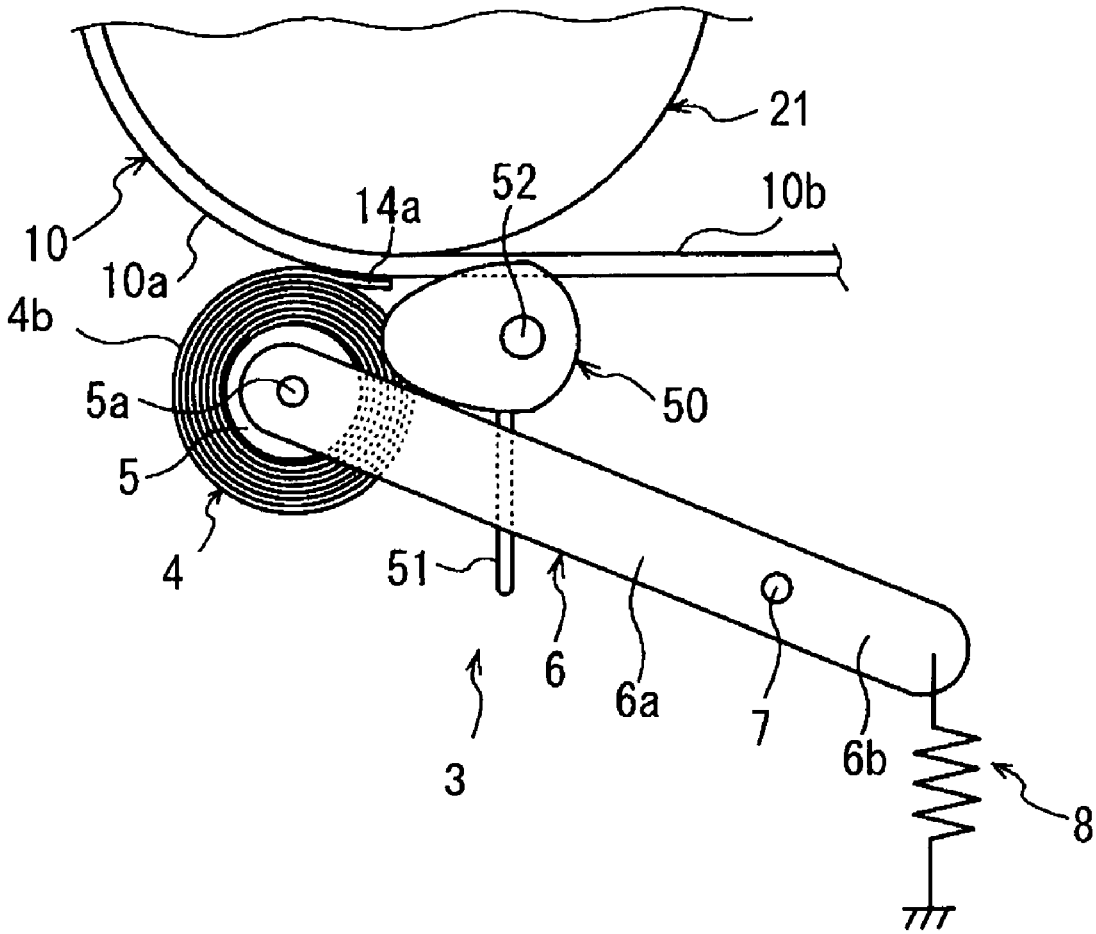
FIG. 3 is a partially enlarged view of FIG. 1 showing a state wherein a sheet roller is abutting on a conveyor belt.

Corresponding to the cleaning instruction in S102, in S104, the CPU 95*a* rotates the cam drive motor 66 through the motor driver 84. Thereby, the cam 50 in the position shown in FIG. 2 rotates in the clockwise direction, turns the turn levers 6 around the shaft member 7 and makes the sheet roller 4 abut on the outer surface 10*a* of the conveyor belt 10 as shown in FIG. 3. The pulse number of rotation of the cam drive motor 66 can be as many as to be enough to turn the turn levers 6 from the position shown in FIG. 2 wherein the sheet roller 4 is separated from the outer surface 10*a* to the position shown in FIG. 3 wherein the peripheral surface of the core member 5 becomes abuttable on the outer surface 10*a* of the conveyor belt 10. When there is an unused portion of the sheet 4*a* on the sheet roller 4, the external diameter of the sheet roller 4 is larger than the shaft member 5 and the turn levers 6 stop the rotation with the sheet roller 4 abutting on the conveyor belt 10.

If the stoppage of the conveyor belt 10 and the abuttment of the sheet roller 4 on the conveyor belt 10 are simultaneously conducted, time is not wasted.

Subsequently, in S106, the CPU 95*a* counterrotates the conveying roller drive motor 65 and move the conveyor belt 10 in the opposite direction to the conveying direction (in the clockwise direction). Corresponding to this movement of the conveyor belt 10, the sheet roller 4 rotates in the counterclockwise direction. The rotational direction of sheet roller 4 when a cleaning is conducted is in the same direction as the direction of sheet 4*a* rolled on the shaft member 5 of the sheet roller 4. In other words, the sheet roller 4 is rotated in the direction of rolling the sheet 4*a*. Thus, when a cleaning is in process, one end of sheet 4*a* does not get unrolled from the sheet roller 4. In this case, the pulse number of rotation of the conveying roller drive motor 65 is as many as to move the conveyor belt 10 for approximately one round. Thereby, a complete cleaning on the outer surface 10*a* of the conveyor belt 10 is conducted.

After a cleaning is completed, in S108, the CPU 95*a* rotates the cam drive motor 66 in the opposite direction. The cam 50 correspondingly rotates in the counterclockwise direction and turns the turn levers 6 around the shaft member 7 to move the sheet roller 4 from the position wherein the sheet roller 4 abuts on the outer surface 10*a* as shown in FIG. 3 to the position wherein the sheet roller 4 is separated from the outer surface 10*a* of the conveyor belt 10 as shown in FIG. 2.

Subsequently, in S110, the counter for the number of conveyed paper which counts the number of conveyed recording media is reset. That is to say, the number of conveyed a recording medium is set zero.

At the same time, in S112, the number of sheet cleaning is counted by the cleaning number counter 95*c*.

After these processes are completed, the cleaning operation is terminated in S114.

Based on the counted cleaning number, a requirement of a sheet renewal is determined as it will be described hereinafter.

Figure 9:
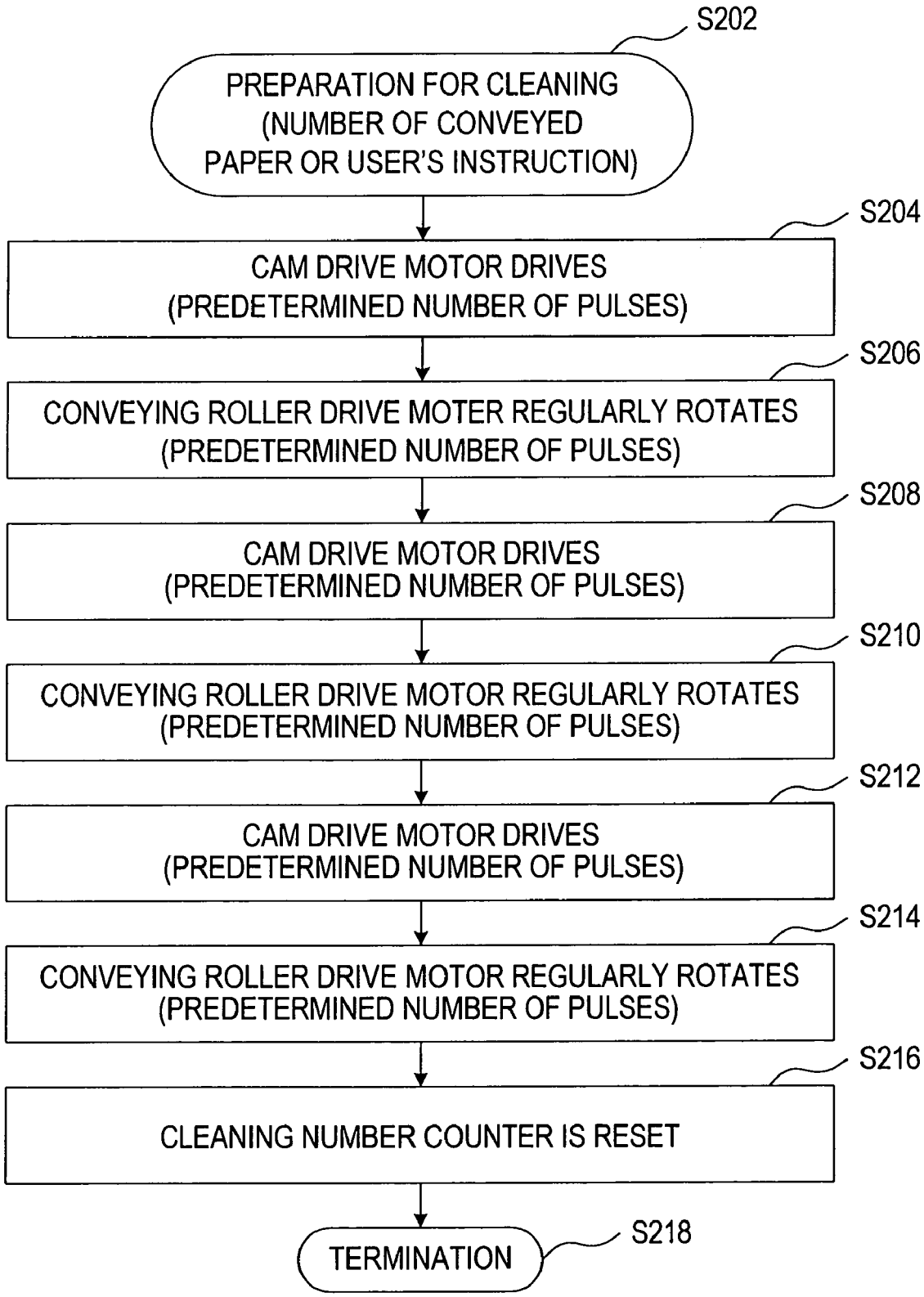
FIG. 9 is a flowchart showing a sheet renewal operation.

The followings describe the renewal operation of the sheet 4*a* on the conveyor belt 10 referring to the flowchart of the CPU operation shown in FIG. 9.

In FIG. 9, the CPU 95*a* reads out the cleaning number from the cleaning number counter 95*c* in S202 and determines whether or not the cleaning number has reached the preset number. When the cleaning number has not reached the preset number, following processes are not executed. On the other hand, when the cleaning number has reached the preset number, after printing is completed, the CPU 95*a* determines that a sheet renewal is required, outputs a renewal instruction and stops the rotation of the conveyor belt 10. The renewal instruction can be done also by a manual operation on a switch by a user, other than by a determination of the CPU 95*a* according to the count on the cleaning number counted by the cleaning number counter 95*c*.

Corresponding to the renewal instruction in S202, in S204, the CPU 95*a* rotates the cam drive motor 66. The cam 50 in the position of FIG. 2 thereby rotates in the clockwise direction, turns turn levers 6 around the shaft member 7 and makes the sheet roller 4 abut on the outer surface 10*a* of the conveyor belt 10. As well as the pulse number for a cleaning, the pulse number of rotation of the cam drive motor 66 can be as many as to be enough to move the turn levers 6 from the position shown in FIG. 2 wherein the sheet roller 4 is separated from the outer surface 10*a* to the position shown in FIG. 3 wherein the peripheral surface of the core member 5 of the sheet roller 4 becomes abuttable on the outer surface 10*a* of the conveyor belt 10.

Subsequently, in S206, the CPU 95*a* rotates the conveying roller drive motor 65 in the direction of unrolling the sheet. That is, when the conveying roller drive motor 65 gives normal rotation to the conveyor belt 10 so that the conveyor belt 10 moves toward the direction of the conveying direction of a recording medium (in the counterclockwise direction of FIG. 1), as shown in FIG. 3, the sheet 4*a* which was previously abutting on the outer surface 10*a* of the conveyor belt 10 gets unrolled from the sheet roller 4 adhering to the outer surface 10*a* of the conveyor belt 10.

The portion of the sheet 4*a* unrolled from the sheet roller 4, as shown in FIG. 4, is conveyed along the lower linear portion of the conveyor belt 10 from the conveying roller 21 to the conveying roller 20 shown in FIG. 1 toward the right direction (the R direction in FIG. 1). In this case, the pulse number of rotation of the conveying roller drive motor 65 can be as many as to be enough to renew the sheet 4*a*. In case of the present embodiment, the pulse number of rotation of the conveying roller drive motor 65 is as many as to rotate the sheet roller 4 for approximately one round. Thereby, the portion of sheet 4*a* approximately as long as one round of the sheet roller 4 is to be renewed.

Subsequently, in S208, the CPU 95*a* rotates the cam drive motor 66. Thereby, as shown in FIG. 4, the cam 50 furthermore rotates from the position shown in FIG. 3 in the clockwise direction. The rotation stopper member 51 disposed on the cam 50 abuts on the peripheral surface of the sheet roller 4 and stops the rotation of the sheet roller 4.

In subsequent S210, the CPU 95*a* gives normal rotation to the conveying roller drive motor 65 and moves furthermore the conveyor belt 10 in the conveying direction of a recording medium. Consequently, the sheet 4*a* unrolled from the sheet roller 4 in S206, corresponding to the movement of the conveyor belt 10, moves toward the conveying roller 20 shown in FIG. 1 in rightward. However because the rotation of the sheet roller 4 is stopped by the rotation stopper member 51 of the cam 50, the sheet 4*a* is cut off on the incisions 86 disposed generally vertically to the rolling direction.

The cut off sheet 4*a*, then, is conveyed along with the conveyor belt 10. The conveyor belt 10 is curved by the conveying roller 20 at the intersection of the lower linear portion of the conveyor belt 10 and the circular arc portion of the conveying roller 20 in the upstream side of the conveying direction. However, the sheet 4*a* is also curved by the guide member 38, thus does not come off from the conveyor belt 10. The sheet 4*a* is conveyed to the upper linear portion adhering to the conveyor belt 10. The sheet 4, afterward, exfoliates from the conveyor belt 10 when only the conveyor belt 10 is curved by the conveying roller 21. The reason why the sheet 4*a* which does not come off in the conveying roller 20 side of the upstream side of the conveying direction automatically exfoliates in the conveying roller 21 side of the downstream side of the conveying direction lies behind the following relation. That is, the diameter of the conveying roller 21, the adhesion and the stiffness of the sheet 4*a* and rotational speed of the conveying roller 21 are chosen, as described below, in order to achieve smooth exfoliation and ejection of the sheet 4*a* at the circular arc portion of the conveying roller 21.

In conducting a continuous cleaning with the sheet roller 4, if the diameter of the conveying roller is 30 mm or less, the adherence of the adhesive sheet 4*a* to the conveyor belt 10 is 3 kgf/20 mm or less, and the stiffness of the base material of the sheet (Clark stiffness) is 45 $cm^3$/100 or more, and if the rotational speed of the conveyor belt is set at 800 mm/sec or less, it is proven that the load which this adherence gives to the rotation of the conveyor belt 10 is small. Moreover, in ejecting the sheet 4*a* from the conveyor belt 10, if the diameter of the conveying roller 21 in the downstream side of the conveying direction is 25 mm, and if the adherence of the conveying roller 21 is set 1 kgf/20 mm or less, even without disposing a special mechanism, a change of the curvature of the conveyor belt 10 made by the conveying roller 21 can provide an automatic exfoliation of the sheet 4*a* from the conveyor belt 10 when the sheet 4*a* is ejected.

It should be noted that the adherence is provided with a reference to JIS Z0237; Testing methods of pressure-sensitive adhesive tapes. This adherence corresponds to the force required to remove an adhesive member from the conveyor belt 10 at the speed of 300 mm/sec in the angle of 180 degree after the adhesive member is pressed against the belt surface of the conveyor belt 10 by a roller on which load of 2 kg is added and rolled back and forth 3 times.

After the cut-off described above is completed, in S212, the CPU 95*a* rotates the cam drive motor 66. The cam 50 thereby rotates in the counterclockwise direction, turns the turn levers 6 around the shaft member 7, releases the rotational stoppage of the sheet roller 4 by the rotation stopper member 51 and moves the turn levers 6 from the position wherein the sheet roller 4 is abutting on the outer surface 10*a* to the position wherein the sheet roller 4 is separated from the outer surface 10*a* of the conveyor belt 10 as shown in FIG. 2.

Subsequently, in S214, the CPU 95*a* gives normal rotation to the conveying roller drive motor 65 and moves the conveyor belt 10 farther in the conveying direction of a recording medium. The sheet 4*a* which is cut off from the sheet roller 4 and adheres to the outer surface 10*a* of the conveyor belt 10 thereby moves to the conveying direction of a recording medium along with the movement of the conveyor belt 10. When the sheet 4*a* reaches the circular arc portion of the conveying roller 21 in the downstream side, the sheet 4*a* automatically exfoliates from the conveying surface 10*a* of the conveyor belt 10 and is ejected to outside of the conveying mechanism 1 with a guide of the paper ejection guide 61.

In S216, the cleaning number of the cleaning number counter 95*c* is reset.

After theses processes are completed, the renewal operation of the sheet 4*a* is terminated in S218.

In case of disposing the sheet roller 4 in the vicinity of the conveying roller 21 in the downstream side of the conveying direction as described above, a sheet roller 4 on which a sheet 4*a* is rolled leftward can be used although the sheet roller 4 in the present embodiment is rolled rightward. In that case, the sheet 4*a* is not unrolled from the sheet roller 4 when the conveyor belt 10 rotates in the conveying direction. Therefore, even when the conveyor belt 10 conveys paper 75 which is a recording medium and printing is conducted on the recording medium, cleaning on the conveyor belt 10 can be simultaneously conducted at the lower portion of the conveying roller 21 in the opposite side of the printing area.

Figure 10:
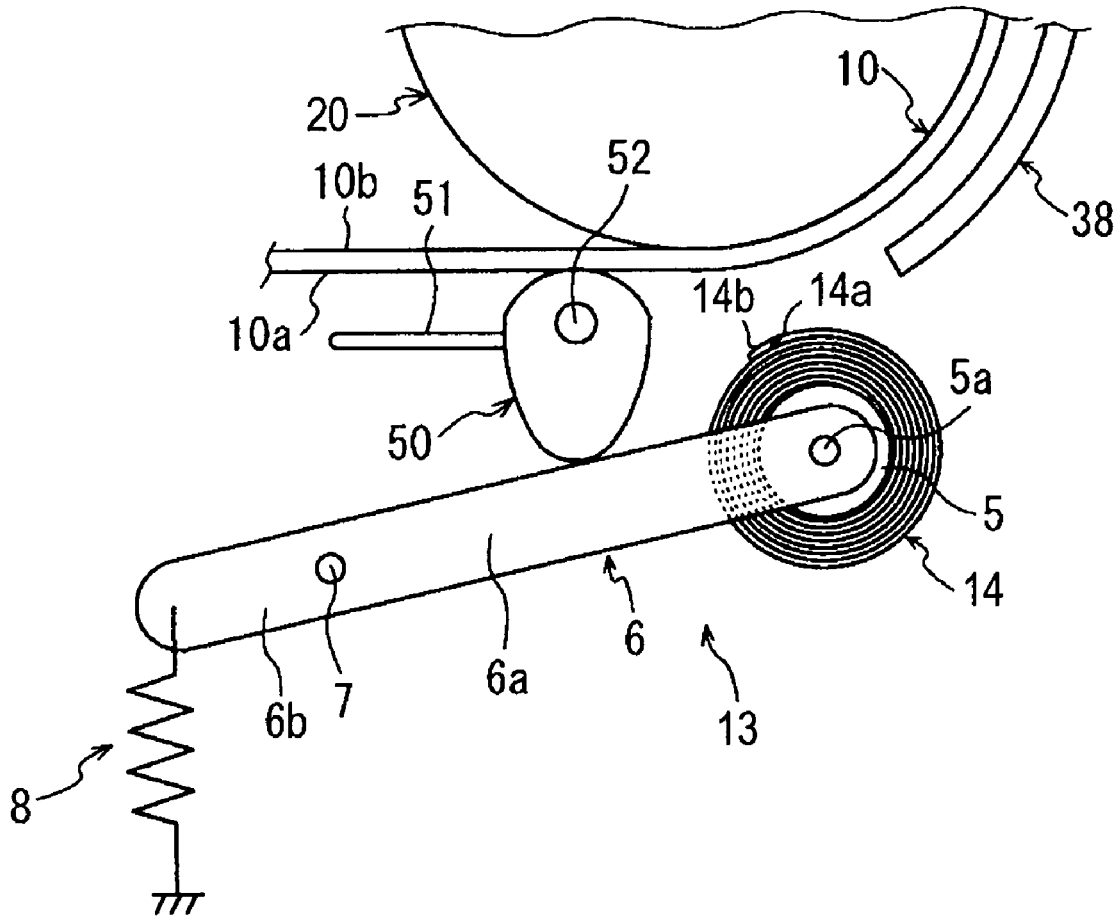
FIG. 10 is a partially enlarged view of a conveying roller and a sheet roller in another embodiment.
Figure 11:
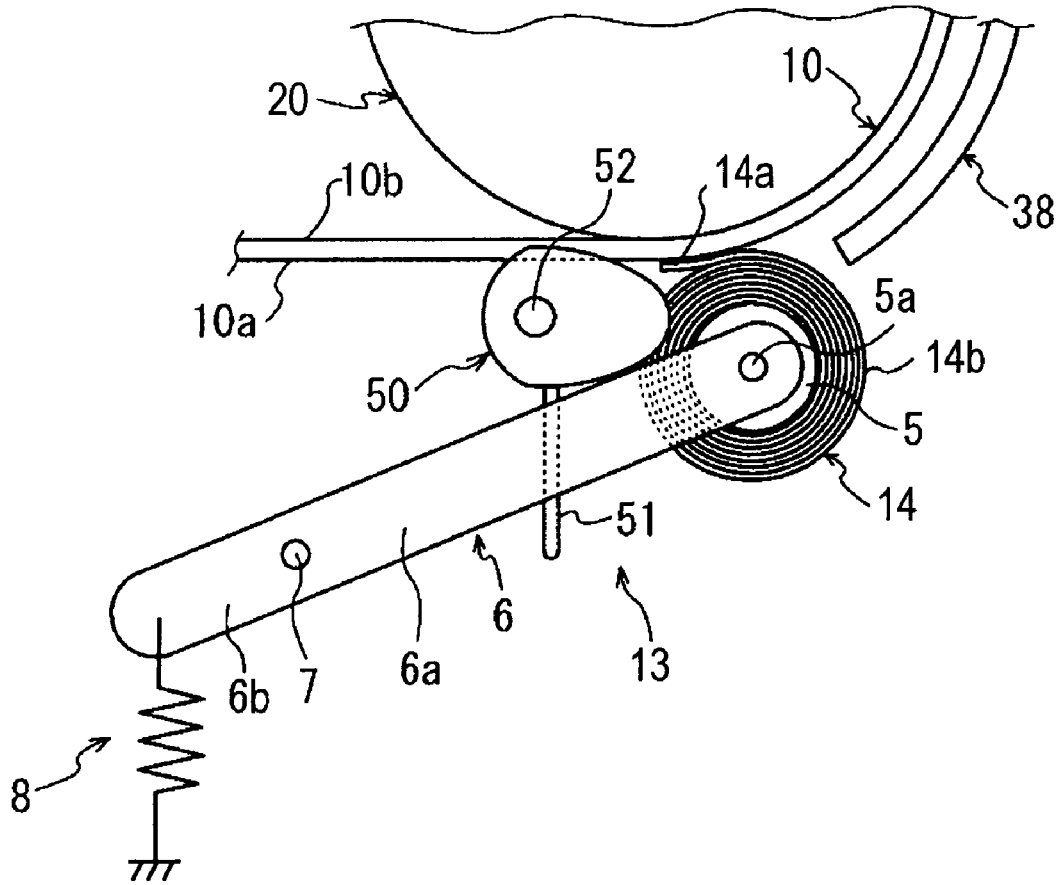
FIG. 11 shows a state of a sheet roller of FIG. 10 abutting on a conveyor belt.
Figure 12:
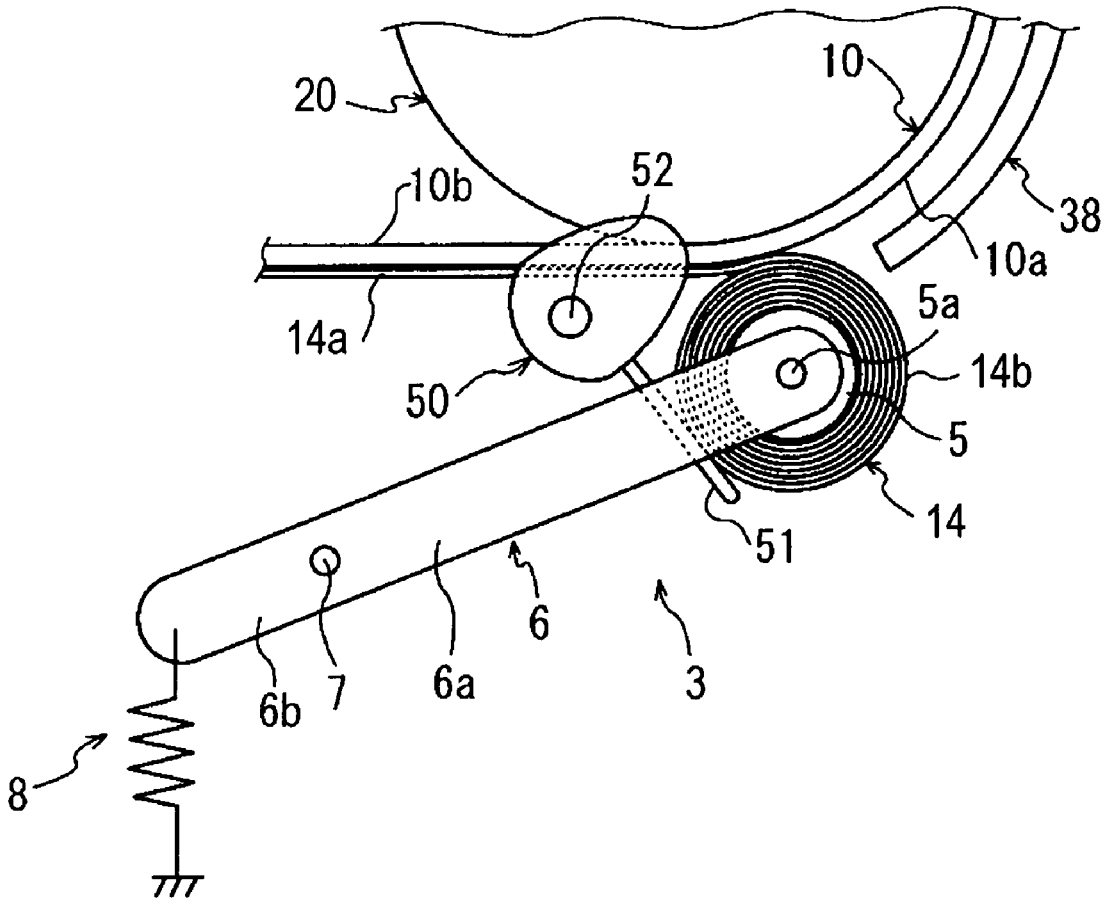
FIG. 12 shows a state of a sheet unrolled from the sheet roller of FIG. 10 and rotation of a sheet roller stopped by a rotation stopper device.

As for a second embodiment, the sheet roller 4 for cleaning the conveyor belt 10 can be disposed in the downside of the conveying roller 20 which is the one located in the upstream side of the conveying direction between the two conveying rollers. The structure thereof is shown in FIGS. 10 to 12. FIG. 10 shows the state wherein the sheet roller 14 is separated from the conveyor belt 10 in the second embodiment. FIG. 11 shows the state of the sheet roller 14 of FIG. 10 abutting on the conveyor belt 10. FIG. 12 shows the state in the structure of FIG. 10 wherein the sheet 14*a* is unrolled from the sheet roller 14 and rotation of the sheet roller 14 is stopped by the rotation stopper member 51.

In this case, as shown in FIG. 10, a sheet roller 14 constituted with an adhesive sheet 14*a* rolled leftward is used. The sheet roller 14 is rolled on a core member 5 as well as the sheet roller 4. The core member 5 is connected with turn levers 6 on its both ends in the length direction. Having a shaft member 7 rotatably supporting the turn levers 6 in between, the turn lever 6 is connected to the core member 5 on one end, and to a spring 8 on the other end. A cam 50 to turn the turn levers 6 and a rotation stopper member 51 to stop the rotation of the cam 50 are disposed in the same manner as described above.

In case of cleaning the conveyor belt 10 with the sheet roller 14, firstly, while the rotation of the conveyor belt 10 is stopped, the sheet roller 14 abuts on the cleaning surface, i.e. outer surface 10*a* of the conveyor belt 10, and the outer surface, i.e. adhesive surface 14*b* of the sheet 14*a*, abuts on the outer surface 10*a* of the conveyor belt 10.

With this status, the conveyor belt 10 is moved in the conveying direction of a recording medium; the same direction as the first embodiment. Consequently, the outer surface 10*a* of the conveyor belt 10 is cleaned by the sheet 14*a*.

In order to renew the sheet 14*a*, while the sheet roller 14 is abutting on the outer surface 10*a* of the conveyor belt 10, the conveyor belt 10 is rotated in the opposite direction to the conveying direction and the sheet 14*a* is adhered to the outer surface 10*a* at the lower linear portion of the conveyor belt 10 and unrolled.

After predetermined length of the sheet 14*a* is unrolled, while the sheet roller 14 is abutting on the outer surface 10*a* of the conveyor belt 10, the cam 50 is rotated in the counterclockwise direction to make the rotation stopper member 51 fixed on the cam 50 abut on the peripheral surface of the sheet roller 14. The sheet roller 14 is then unrotatable since the rotation is stopped by the rotation stopper member 51. The sheet 14*a* is cut off at the incisions 86 preformed generally at the right angle in the rolling direction. Subsequently, the cam 50 is rotated in the clockwise direction to free the abuttment of the sheet roller 14 from the rotation stopper member 51. The predetermined length of the sheet 14*a* remained on the conveyor belt 10 passes the circular arc portion of the conveying roller 20 in the upstream side of the conveying direction of the conveyor belt 10 conveyed in the conveying direction by the conveyor belt 10. After the sheet 14*a* with the predetermined length passes the upper linear portion, the sheet 14*a* exfoliates by itself from the outer surface 10*a* of the conveyor belt 10 at the circular arc portion of the conveying roller 21 in the downstream side of the conveying direction, and gets ejected to outside of the conveying mechanism 1 with a guide of the paper ejection guide 61.

The cut-off sheet 14*a*, then, does not come off from the conveyor belt 10 even at the intersection of lower linear portion and the circular arc portion in the upstream side of the conveying direction of the conveyor belt 10 because a guide member 38 is disposed. The cut-off sheet 14*a* is, hence, conveyed to the upper linear portion adhering to the conveyor belt 10.

In case the sheet roller 4 is disposed under the conveying roller 20 in the upstream side of the conveying direction, a cleaning on the conveyor belt 10 can be conducted under the conveying roller 20 in the opposite side of the printing area simultaneously with a printing on a recording medium after the conveyor belt 10 conveys the recording medium; paper 75. This can be achieved because the sheet 14*a* of the sheet roller 14 is rolled leftward. Even when the conveyor belt 10 rotates in the conveying direction while the sheet roller 14 abuts on the outer surface 10*a* of the conveyor belt 10, sheet 14*a* does not get unrolled corresponding to the rotation, but the sheet roller 14 rotates in the clockwise direction. This sheet roller 14, in consequence, can stick foreign objects such as dust adhered to the outer surface 10*a* of the conveyor belt 10 more preferably.

The aforementioned gives examples of abuttment and separation of the conveyor belt 10 and sheet 4*a* or 14*a* achieved mainly based on the displacing movement of the shift member connected to the sheet rollers 4 or 14 on which sheets 4*a* or 14*a* is rolled. These kinds of movements of abuttment or separation are achieved by having the sheet roller 4 or 14 fixed in specific positions. They can be achieved also by displacing the conveyor belt 10. This can be achieved either way by having only the conveyor belt 10 displace, or by having the entire part of the conveying member including the conveyor belt 10 displace. In either case, the method to cut off the adhesive sheets 4*a* or 14*a* after abuttment is as described above. However, it is possible to change the method within the purpose of the present invention.

In the present embodiment, the incisions 86 are formed with predetermined length of intervals generally at the right angle to the rolling direction of the sheets 4*a* or 14*a*. However, it should be noted that instead of disposing the incisions 86, a cutter, not shown in the drawing, may be disposed to cut off the sheet 4*a* or 14*a* at a position where the rotation stopper member 51 abuts on the sheet 4*a* or 14*a*. The sheet 4*a* or 14*a* can be cut off with a predetermined length by the cutter.

INDUSTRIAL APPLICABILITY

As described above, the image forming apparatus and the cleaning method thereof related to the present invention are advantageous to keep a conveying surface which conveys a recording medium constantly clean. It is especially suitable for a compact structure of an inkjet printer which is formed by embodying the image forming apparatus of the present invention.

What is claimed is:

1. An image forming apparatus comprising:

a conveying device having a conveying surface to convey a recording medium;

a sheet roller mounted rotatably and rolled with a sheet having a cleaning surface which abuts on the conveying surface to clean the conveying surface; and a drive control device which drives the conveying device so that the sheet roller rotates in a direction to roll the sheet when a cleaning is conducted, and rotates in a direction to unroll the sheet when the cleaning surface is renewed.

2. The image forming apparatus as set forth in claim 1, wherein the conveying device is extended rotatably between at least two rollers and comprises a conveyor belt which conveys the recording medium.

3. The image forming apparatus as set forth in claim 2, wherein the conveying surface of the conveyor belt comprises an adhesive member constituted with silicone resin.

4. The image forming apparatus as set forth in claim 2, wherein the sheet roller is disposed adjacent to one of the two rollers.

5. The image forming apparatus as set forth in claim 1, further comprising a shift device to make the sheet roller abut on the conveying surface and separate therefrom.

6. The image forming apparatus as set forth in claim 5, wherein the shift device includes a support portion which supports the sheet roller rotatably and detachably.

7. The image forming apparatus as set forth in claim 5, wherein the shift device biases the sheet roller toward the conveying surface with a biasing device.

8. The image forming apparatus as set forth in claim 7, wherein the shift device comprising:

turn levers for supporting the sheet roller rotatably, being supported rotatably around an axis parallel to the shaft center of the sheet roller, and biasing the sheet roller toward the conveying surface with the basing device; and a cam for turning the turn levers so that the sheet roller separates from the conveying surface against the biasing force of the biasing device.

9. The image forming apparatus as set forth in claim 8, wherein the cam includes a cam surface which switches a position wherein the sheet roller is separated from the conveying surface and a position wherein the sheet roller abuts on the conveying surface.

10. The image forming apparatus as set forth in claim 8, wherein the cam is a rotational cam.

11. The image forming apparatus as set forth in claim 7, furthermore comprising a rotation stopper device which stops the rotation of the sheet roller to regulate rotational amount of the sheet roller in the unrolling direction of the sheet.

12. The image forming apparatus as set forth in claim 11, wherein the rotation stopper device is integrated with the cam.

13. The image forming apparatus as set forth in claim 1, wherein incisions are formed on the sheet with predetermined length of intervals in the direction perpendicular to the rolling direction.

14. The image forming apparatus as set forth in claim 1, wherein the cleaning surface comprises a sticky member whose adhesive force to foreign objects adhered to the conveying surface is larger than the adhesive force of foreign objects to the conveying surface.

15. The image forming apparatus as set forth in claim 14, wherein the diameter and rotational speed of the roller and the adhesive force and stiffness of the sheet are adjusted so that the sheet exfoliates automatically from the conveying surface in the vicinity of the roller.

16. The image forming apparatus as set forth in claim 14, wherein the sticky member is constituted with a kind of resin in other group than the group to which the resin constituting the adhesive member belongs.

17. The image forming apparatus as set forth in claim 1, wherein the drive control device comprises a cleaning requirement determination device which determines whether or not a cleaning on the conveying surface is required.

18. The image forming apparatus as set forth in claim 17, wherein the cleaning requirement determination device comprises a detection device for the number of conveyed paper which detects the number of the recording media conveyed to the image forming area and determines that a cleaning on the conveying surface is required when the number of conveyed paper reaches a predetermined number.

19. The image forming apparatus as set forth inclaim 17, wherein the drive control device further includes a shift control device which makes the sheet roller abut on the conveying surface with the shift device corresponding to the cleaning requirement determination device determining that a cleaning on the conveying surface is required.

20. The image forming apparatus as set forth in claim 1, wherein the drive control device comprises a sheet renewal requirement determination device which determines whether or not a newel of the sheet is required.

21. The image forming apparatus as set forth in claim 20, wherein the sheet renewal requirement determination device comprises a cleaning number detection determines that a renewal of the sheet is required when the cleaning number reaches a predetermined number.

22. The image forming apparatus as set forth in claim 20, wherein the drive control device changes the movement direction of the conveying device corresponding to the sheet renewal requirement determination device determining that a renewal of the sheet is required, thereby unrolls the sheet for a predetermined length, and adheres to the conveying surface.

23. A cleaning unit to clean a conveying surface of a conveying device which conveys a recording medium comprising:

a sheet roller mounted rotatably and rolled with a sheet having a cleaning surface which abuts on the conveying surface to clean the conveying surface;

a shift device to make the cleaning surface of the sheet roller abut on the conveying surface and separate therefrom and makes the cleaning surface of the sheet roller abut on the conveying surface when a cleaning is conducted; and a cutter device disposed to cut off the sheet at a position where a rotation stopper member abuts the sheet when the sheet is unrolled to renew the cleaning surface.

24. A cleaning method of an image forming apparatus comprising a conveying device having a conveying surface to convey a recording medium; a sheet roller mounted rotatably and rolled with a sheet having a cleaning surface which abuts on the on the conveying surface and separate therefrom; and a drive control device which drives the conveying device, the method comprising steps of:

making the cleaning surface abut on the conveying surface with the shift device, driving the conveying device with the drive control device in a direction so that the sheet is rolled, and cleaning the conveying surface with the sheet roller for a cleaning; and rotating the sheet roller in a direction so that the sheet is unrolled, and reversing the rotational direction of the conveyor belt with the drive control device so that the sheet is unrolled for a predetermined length and adheres on the conveying surface for a renewal of the cleaning surface.

25. The cleaning method as set forth in claim 24, wherein the image forming apparatus further comprising a cutter device to cut off the sheet unrolled, and wherein the usage of the image forming apparatus further comprising a step of cutting of the sheet unrolled by the cutter device.

26. The cleaning method as set forth in claim 24 further comprising a step of separating the sheet roller from the conveying surface by the shift device.

* * * * *